United States Patent [19]

Leider

[11] Patent Number: 4,706,860

[45] Date of Patent: Nov. 17, 1987

[54] BALL QUIVER

[76] Inventor: Michael J. Leider, 4761 Cathy Ave., Cypress, Calif. 90630

[21] Appl. No.: 864,330

[22] Filed: May 19, 1986

[51] Int. Cl.[4] ..... A45F 5/00

[52] U.S. Cl. ..... 224/247; 224/224; 224/919

[58] Field of Search ..... 224/247, 919, 224, 242, 224/251, 253, 264, 226, 231, 254

[56] References Cited

U.S. PATENT DOCUMENTS

| | | | |
|---|---|---|---|
| 1,610,344 | 12/1926 | Williams | 224/919 X |
| 3,100,590 | 8/1963 | Bohlsen | 224/242 |
| 4,269,338 | 5/1981 | Sichel | 224/919 X |
| 4,572,415 | 2/1986 | Fehr | 224/253 |

*Primary Examiner*—Stephen Marcus
*Assistant Examiner*—Robert M. Petrik
*Attorney, Agent, or Firm*—Grant L. Hubbard

[57] ABSTRACT

A ball quiver for holding tennis balls is disclosed.

2 Claims, 2 Drawing Figures

BALL QUIVER

FIELD OF THE INVENTION

This invention relates to sporting equipment generally and particularly to tennis equipment and, more particularly to apparatus for holding tennis balls on the player during play.

BACKGROUND OF THE INVENTION

Traditionally, a tennis player carries three tennis balls during play. Tennis clothing has, traditionally, been equipped with large pockets to permit the player to carry the balls in the pocket. Even with the best designs, however, these pockets are inconvenient, and often are difficult to reach to either insert or retrieve balls. There are a number of devices available which have sought to solve the problem, and each has provided a limited improvement in certain respects but all have fallen short of completely solving the problem. One such effort is exemplified by the device disclosed in U.S. Pat. No. 4,269,338, Burton F. Sichel, issued May 26, 1981. The Sichel patent discloses a ball holder in the form of a cage having a spine, a ring extending perpendicularly from the spine and retaining ends, the balls being held in the cage by elastic ball retaining members.

The present invention comprises an improvement over the prior art, providing a cage, having a spine, at least one ring, retainers, the cage being of generally resilient material, but with sufficient rigidity to form a cage which will hold two or more, typically three, tennis balls, and which is formed in combination with a diamond-shaped harness and a belt for retaining the cage snugly against the waist of the user, the spine being in a vertical orientation, the cage being sufficiently resilient to permit balls to be easily inserted into and removed from the cage.

SUMMARY OF THE INVENTION

The present invention is a tennis ball quiver, though it could equivalently be adapted to hold any ball or round object, such as golf balls, ping-ping balls, etc. The invention comprises the combination of a cage formed of a spine, at least one ring and at least one retainer so constructed and configured for holding at least two tennis (or other) balls, the cage being sufficiently resiliently to permit a tennis ball to be removed from and inserted into the cage by resilient displacement of a retainer or ring, and means for securing the cage to the user. The invention resides in improved securing means which comprises a belt for extending around the waist of the user and a diamond-shaped harness attaching the belt to the spine of the cage, the harness comprising four straps, two straps attached adjacent one end of the spine and two straps attached adjacent the other end of the spine, two straps attached to one end of the belt and two straps attached to the other end of the belt. The cage and securing means constructed and configured to secure the cage snugly, the spine extending vertically, against the waist of the user during use.

In a preferred form, the invention comprises a spine, rings and retainers so constructed and configured as form a cage for holding at least three tennis balls, the cage being sufficiently resilient to permit a tennis ball to be removed from and inserted into the cage by resilient displacement of a retainer or ring, and means for securing the cage to the user, the invention residing in improved securing means which comprises a belt for extending around the waist of the user and a diamond-shaped harness attaching the belt to the spine of the cage, the harness comprising four straps, two such straps being attached adjacent one end of the spine and two such straps being adjacent the other end of the spine, two of the straps being attached to one end of the belt two of the straps being attached to the other end of the belt, the cage and securing means being so constructed and configured as to secure the cage snugly, the spine extending vertically, against the waist of the user during use, and belt comprising length adjusting means comprising a ring and hook-and-loop fastener means intermediate the ends thereof.

DETAILED DESCRIPTION OF THE PREFERRED EMBODIMENT

The following description is given with respect to the application of the invention as a tennis ball quiver although the invention may be used as a quiver for any ball of any size, or for any other round or generally round object. The specific materials, elements and structures are not the essence of the invention, and considerable variation is permitted within the scope of the invention.

Figure 2:
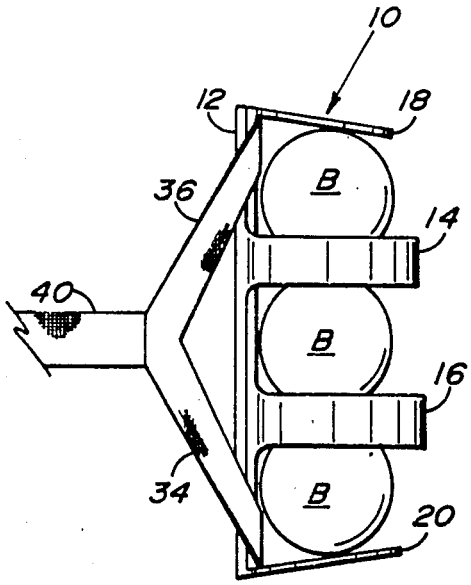
FIG. 2 shows a side view of the cage with the diamond-shaped harness attached thereto.

In the preferred embodiment, a cage 10, best shown in FIG. 2, is provided. The cage comprises a spine 12, which in use rests vertically against the waist of the user, at least one ring and, two rings 14 and 16 extending perpendicularly to the spine, and retaining means, in the form of plates, 18 and 20 at the respective ends of the spine. The cage is typically formed of a generally rigid material, but one which has sufficient resilience to permit the tennis balls to be removed from and inserted into the cage. A number of polymers, so called plastics, are quit suitable for forming the cage portion of the quiver. Polycarbonate, polyvinylchloride, polypropylene, polyethylene, and various other polymers are conveniently compounded, using well known and standard techniques, for being extruded or otherwise formed into configurations which are rigid to the extent that they will retain a given configuration when not under stress or torsion, but which can be resiliently flexed from and will resiliently return to their original configuration. Polyacetals, for example, are quite conveniently configured into objects of this type.

The cage is, preferably, formed of a single molded polymeric body. This is not essential to the invention, however, as the various components can be individually formed and secured together using a traditional and well known adhesive, rivet or other fastener techniques.

Figure 1:
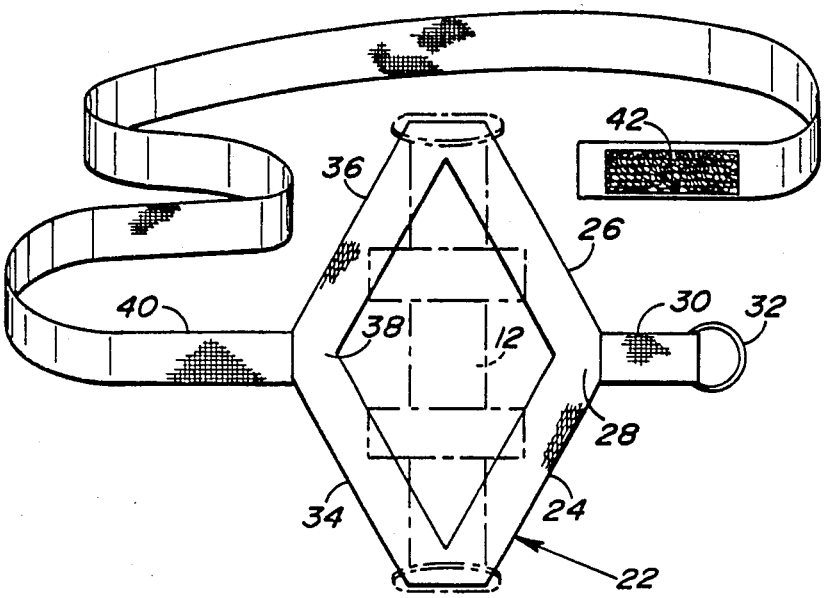
FIG. 1 shows the improved securing means of this invention attached to a cage, the combination forming the quiver of the invention, the cage being shown in dotted lines.

Securing means comprising a diamond-shaped harness and a belt are provided. The diamond-shaped harness comprises four straps, 24 and 26, and 34 and 36. The straps 24 and 26 are secured together at one end, as shown at 28 and to one end of a belt 30 which, in the preferred embodiment, has affixed to it a ring 32, and function which will be explained. The diamond-shaped harness also comprises straps 34 and 36 secured at one end together, as shown at 38, and to the other end of the belt 40. The belt has formed intermediate the ends thereof means for adjusting the length of the belt comprising the ring 32 and a fastener which, in the preferred embodiment, is a hook-and-loop type fastener of the type sold under the trademark VELCRO. One end of strap 24 and one end of strap 34 are attached together to one end of the spine 12, as shown in both FIG. 1 and FIG. 2. Likewise, one end of strap 26 and one end of strap 36 are secured together and to the other end of the spine 12.

Thus, the tennis ball quiver comprises the combination of a spine 12, one or more rings 14 and 16, one or more retainers 18 and 20, the spine, rings and retainers forming a cage for tennis balls, indicated at B, and being sufficiently resilient to permit the balls to be inserted and removed from the cage, combined with means for securing the cage to the waist of the user comprising a belt, the ends of which 30 and 40 are secured to a diamond-shaped harness. The diamond-shaped harness comprises four straps 24, 26, 34 and 36, two straps, 24 and 34 being attached adjacent one end of the spine and two straps, 26 and 36 being attached adjacent the other end of the spine, two of the straps 24 and 26 being attached to one end of the belt and two of the straps, 34 and 36 being attached to the other end of the belt, all secured in a combination which will secure the cage snugly against the waist of the user with the spine in a vertical orientation, to permit balls to be easily and quickly removed from and inserted into the cage of the quiver.

While the invention disclosure as given above speaks in terms of straps, belts, and the like, it will be understood that webbing, fabric or other equivalent materials and configurations may be used. What is important to the invention is the concept of a diamond-shaped harness or structure secured at the respective ends of the spine. Within the scope of the invention, as set forth in the following claims, considerable variation and adaptation is, therefor, permitted.

INDUSTRIAL APPLICATION

This invention finds application in amateur and professional sports, most frequently in tennis.

What is claimed is:

1. In a tennis ball quiver comprising, in combination, a spine, at least one ring and retainers so constructed and configured as to form a cage for holding at least two tennis balls, the cage being sufficiently resilient to permit a tennis ball to be removed from and inserted into the cage by resilient displacement of a retainer or ring, and means for securing the cage to the user, the improvement wherein the securing means comprises first and second belt halves and a diamond-shaped harness attaching the belt to the spine of the cage, the diamond shaped harness comprising four straps, a first end of a first pair of said straps being attached adjacent a first end of the spine and a first end of a second pair of said straps being attached adjacent a second end of the spine, the first pair of straps extending downwardly and outwardly from the spine and the second pair of straps extending upwardly and outwardly from the spine, when the quiver is in use, the second end of one of the first pair and one of the second pair of straps being attached to one end of the first belt half, the second end of the other of the first pair and the other of the second pair of straps being attached to one end of the second belt half, the two pairs of straps defining, when the quiver is in use, a diamond having one point above and one point below the belt, and one point on one side and one point on the other side of the spine, for thereby holding the spine of the quiver snugly against the side of the user.

2. The ball quiver of claim 1 wherein the belt further comprises: length adjusting means comprising a ring and hook-and-loop fastener means secured to the respective other ends of the first and second belt halves.

* * * * *